US005341982A

United States Patent [19]

Syers

[11] Patent Number: 5,341,982

[45] Date of Patent: Aug. 30, 1994

[54] FILE FOLDER HAVING HORIZONTAL AND VERTICAL STOWAGE

[76] Inventor: Charles S. Syers, Box 1879 St. Matthew St., San Mateo, Calif. 94401

[21] Appl. No.: 77,984

[22] Filed: Jun. 16, 1993

[51] Int. Cl.[5] ..... B65D 27/00; B42F 21/00

[52] U.S. Cl. ..... 229/1.5 R; 40/359

[58] Field of Search ..... 229/1.5 R; 40/359

[56] References Cited

U.S. PATENT DOCUMENTS

| | | | |
|---|---|---|---|
| 958,050 | 5/1910 | Whipple . | |
| 1,008,352 | 11/1911 | Meyers . | |
| 1,544,818 | 1/1925 | Dawson . | |
| 1,654,545 | 1/1928 | Lindsay . | |
| 1,697,988 | 1/1929 | Lindsay . | |
| 2,969,793 | 1/1961 | Fürrer | 40/359 |
| 4,143,477 | 3/1979 | Reynolds . | |

FOREIGN PATENT DOCUMENTS

| | | |
|---|---|---|
| 1565587 | 3/1969 | France . |
| 1190313 | 5/1970 | United Kingdom . |

*Primary Examiner*—Allan N. Shoap
*Assistant Examiner*—Jes F. Pascua
*Attorney, Agent, or Firm*—Townsend and Townsend Khourie and Crew

[57] ABSTRACT

A file folder having a tab capable of rotation is disclosed for displaying file identification and content information dependent upon the orientation of the file during storage. In the preferred embodiment, a rectilinear file having major and minor edges is utilized. The rotatable tab is placed at the corner remote from the major and minor edges on which the file is designed to rest. Dependent upon file storage, rotation of the tab occurs to display file identification and content information most conveniently. Provision is made to notch the file side to which the rotating tab is attached to positively lock the rotating tab in the desired orientation with respect to the file.

4 Claims, 3 Drawing Sheets

FILE FOLDER HAVING HORIZONTAL AND VERTICAL STOWAGE

This invention relates to file folders and the tabs that displace location and content of the folders. Specifically, a file folder with a rotatable tab mounted at the corner of the folder is disclosed so that the file folder can be stacked horizontally or vertically and still display file location and content information.

BACKGROUND OF THE INVENTION

File folders are well known. Specifically, such folders at a minimum include front and rear folder sides and are hinged—typically by a bent paper or cloth hinge—between the front and rear folder sides. It is common for files to have multiple leaves between the front and rear folder sides.

The file folders typically have an information tab protruding upwardly from either the front or rear folder side. This tab is a permanent extension of one of the folder sides and protrudes above the normal height of the remainder of the file. When the files are stacked with their respective contents, side by side, the tabs display identification and content information. The display of this information is above the height of the front and rear sides and any internal multiple leaves.

Files are typically rectilinear—either square or rectangular—as viewed perpendicular to one of their respective front and rear sides. Further, files are typically stacked and stowed serially on edge on side-by-side. In the normal storage regimen, similar files are stored on similar edges. Thus, where the front and rear sides are rectangular and folded along a major edge of the sides, the side-by-side files will be similarly stored. Give a complete shelf of such files, tabs protruding upwardly from sides containing the location and content information are permanently formed into the sides of the panel.

However, when tabs have permanent formation into the sides of the panel, normal file orientation on one or the other of the side edges is fixed. For example, where rectangular files are rested on a folding major side, typically the tab protrudes upward from the front or rear panel major side opposite the folding side.

Sometimes, however, it is desired that file be stowed on either the front or side edges. When this is the case, the protrusion of the tabs remains the same. As the tabs are integral with the front and side panels, their relative position with respect to the file folder remains unchanged. Thus if the file is designed to be stored with one major edge resting on a file retaining shelf, the file tab protrudes upwardly from the opposite major edge. When the same file is stored by resting on a minor edge, the file tab still protrudes from the major edge—whether or not the tab can be conveniently located. Thus, where change of file storage orientation is undertaken, normal files must be completely replaced.

SUMMARY OF THE INVENTION

A file folder having a tab capable of rotation is disclosed for displaying file identification and content information dependent upon the orientation of the file during storage. In the preferred embodiment, a rectilinear file having major and minor edges is utilized. The rotatable tab is placed at the corner remote from the major and minor edges on which the file is designed to rest. Dependent upon file storage, rotation of the tab occurs to display file identification and content information most conveniently. Provision is made to notch the file side to which the rotating tab is attached to positively lock the rotating tab in the desired orientation with respect to the file.

DESCRIPTION OF THE PREFERRED EMBODIMENT

Figure 1A:
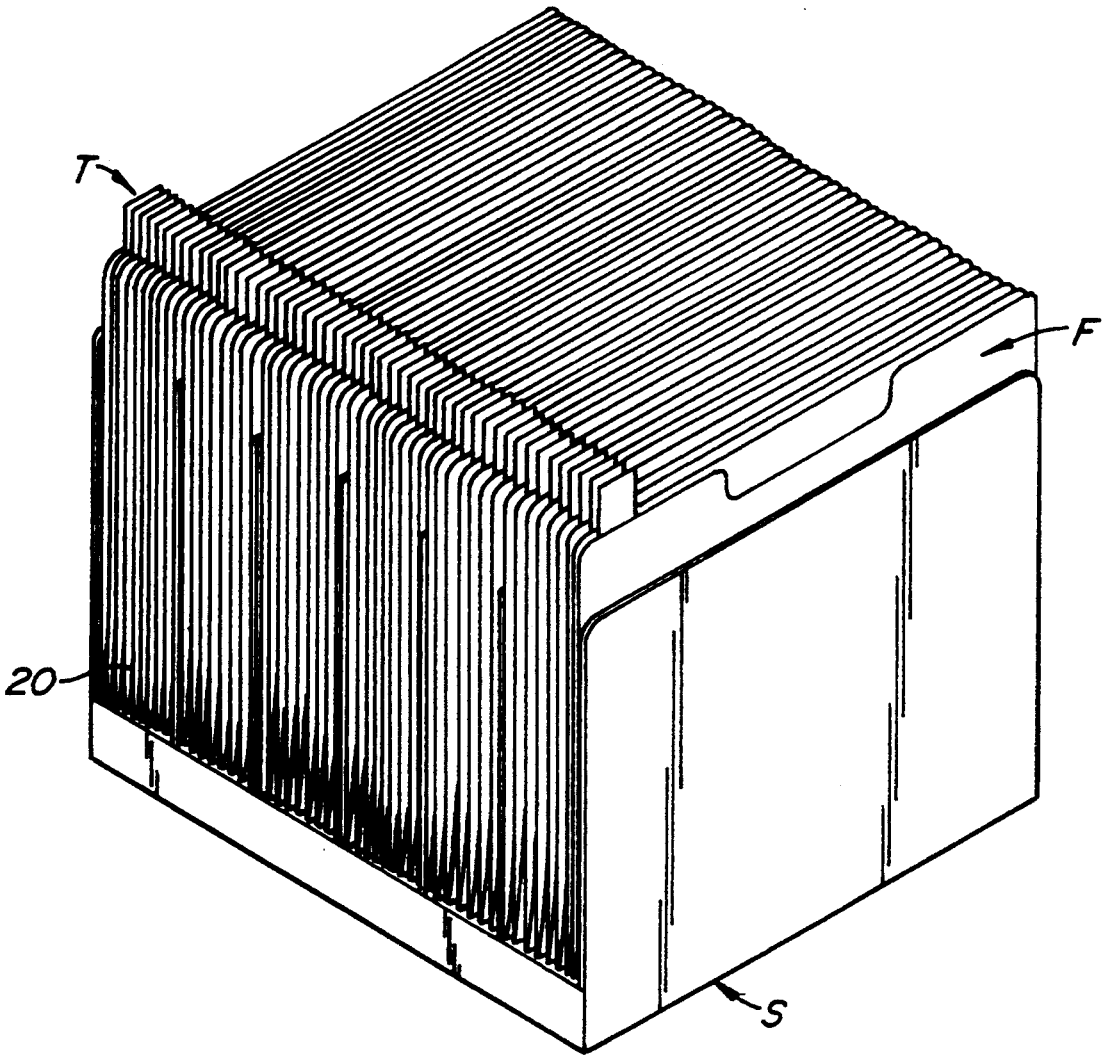
FIGS. 1A and 1B are respective perspective views of the file folders of this invention, here shown in a rectilinear format with the rotating tabs at differing orientations to display their respective identification and content information.
Figure 1B:
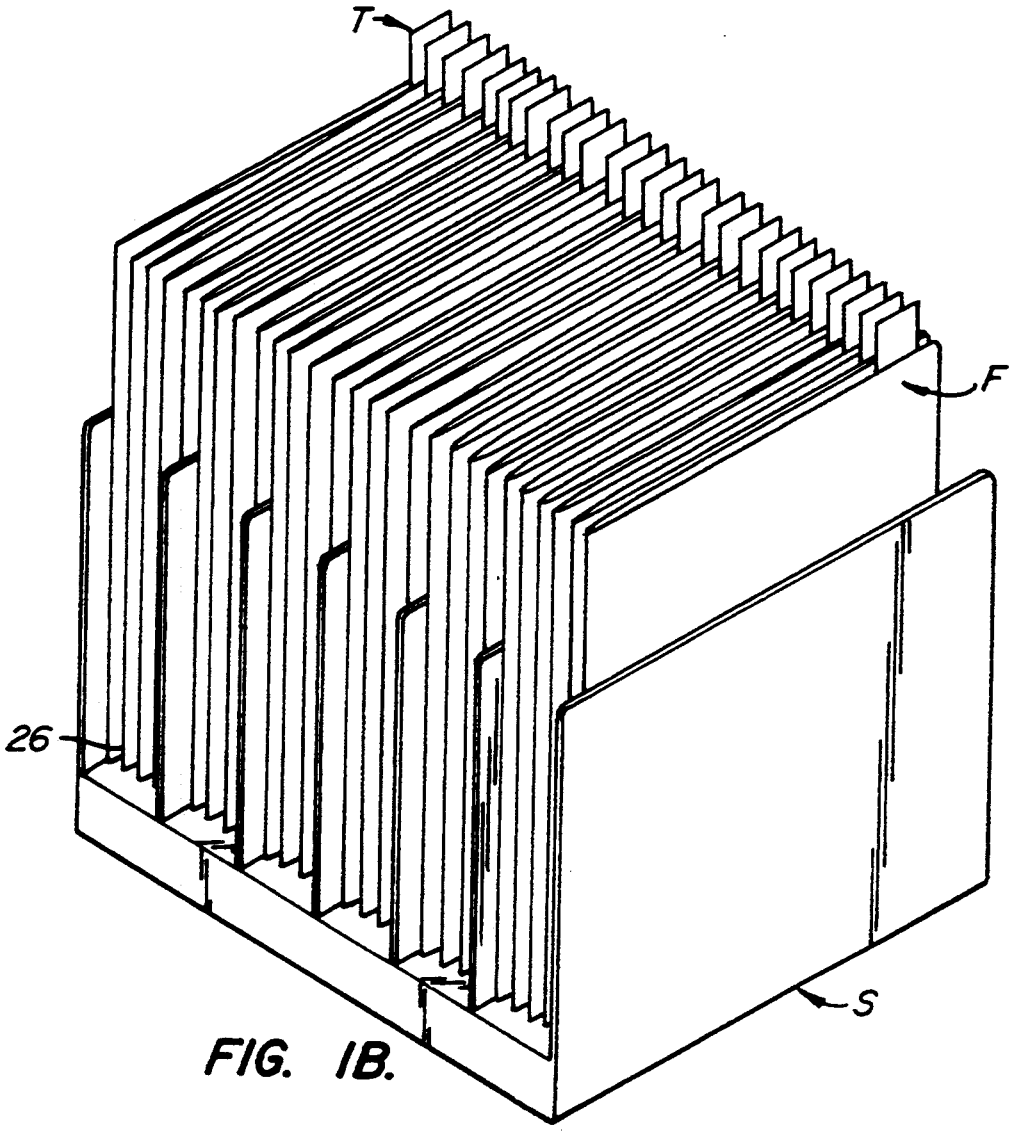

Referring to FIGS. 1A and 1B, a perspective view of a group of files F stored on a shelf S are shown. As can be seen, it is the differing directional orientation of the files in their stacking on the respective shelves which is the subject matter of this invention.

Figure 2:
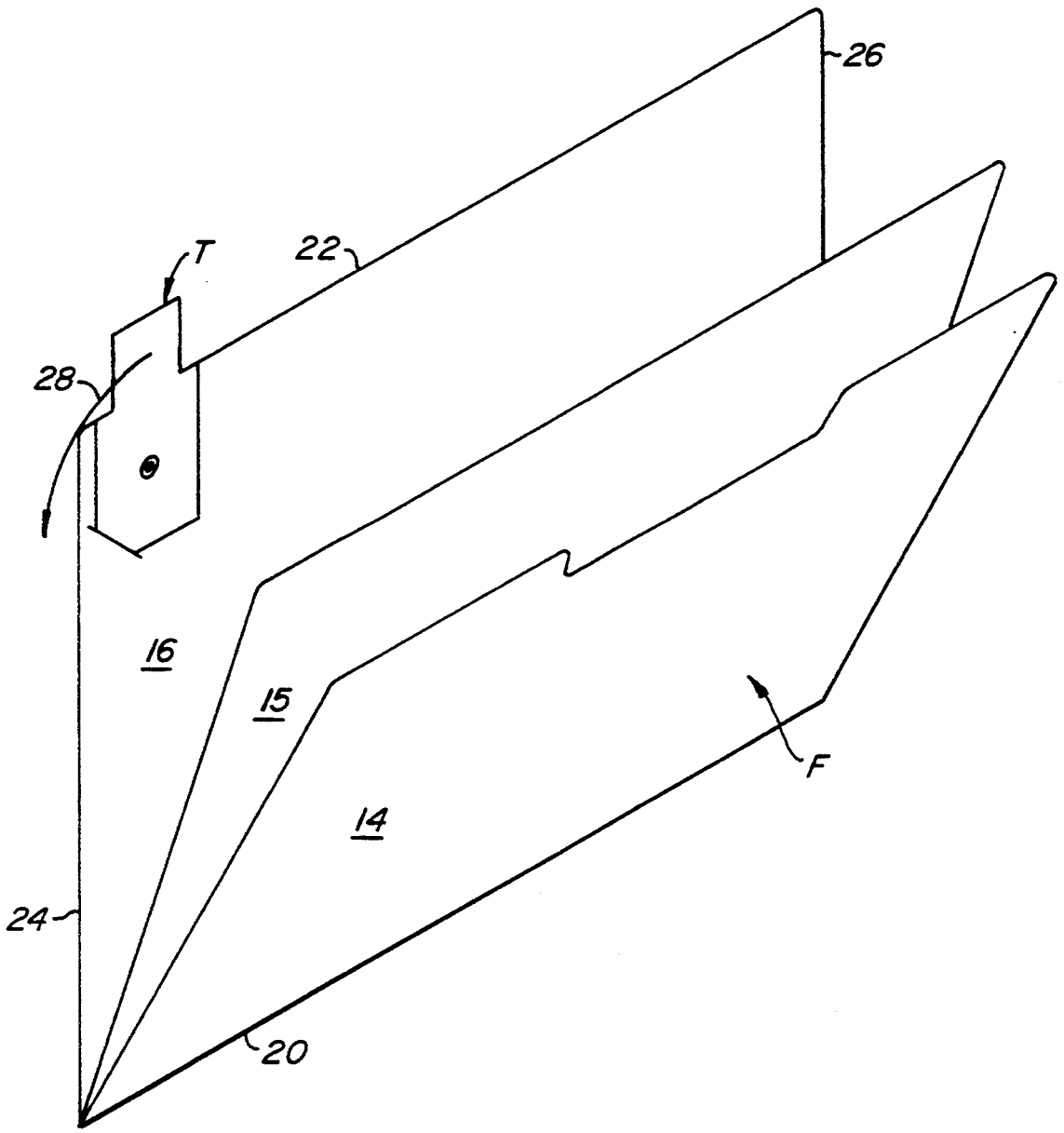
FIG. 2 is a side elevation view of the file of this invention.

Referring briefly to FIG. 2, a typical file F is shown having file front side 14, rear side 16 with an intermediate folding leaf 15. As can be seen—and as is the usual case the file is rectilinear (although the profile of some files is square) with rear side having major sides 20, 22 and minor sides 24, 26. Hinging occurs to front side 14, inner leaf 15, and rear side 16 along major side 20. Tab T is shown fastened to the corner of rear side 16 between minor side 24 and major side 22. Tab T is rotatable in direction of arrow 28.

Returning to FIG. 1A, it can be seen that files F are stored on major side 20. In Fig. 1B, the same files F are stored on minor edge 26. In both cases, tabs T are oriented to display their information upwardly. How this is done in the particular construction of this invention can be seen with respect to FIGS. 3A and 3B.

Figure 3C:
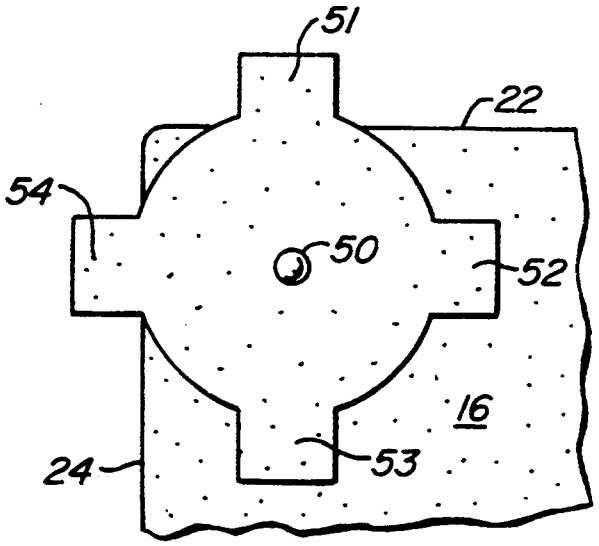
FIGS. 3A, 3B, and 3C are respective views of the 10 rotating tabs illustrating the tab rotated to alternate respective positions for display.
Figure 3A:
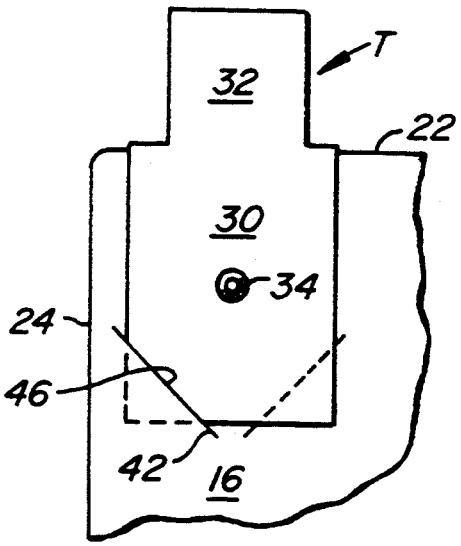

Referring to FIG. 3A, tab T includes a mounting portion 30, an identification and content display portion 32. Mounting portion fastens to rear side 16 at rivet 34.

It can be seen, that rear panel 16 includes two diagonal slots 42, 44. Referring to FIG. 3A, when tab mounting portion 30 faces identification and content display portion 32 above edge 22, the left corner 46 engages slot 42 holding tab mounting portion 30. This is the orientation shown in FIG. 1A.

Figure 3B:
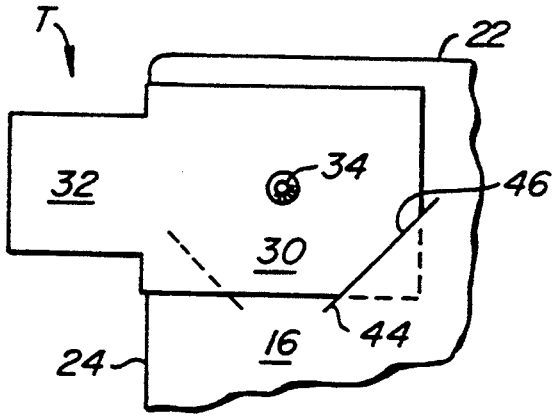

Referring to FIG. 3B, when tab mounting portion 30 faces identification and content display portion 32 above edge 24, left corner 46 engages slot 44. This is the orientation shown in FIG. 1B.

Referring to FIG. 3C, a wheel type rotating tab is illustrated. It will be noted that this wheel type tab includes a central rivet 50 and four tabs 51–54. Tabs 51–54 protrude from the top and side edge dependant upon the degree of rotation. It will be noted that in this embodiment, by coloring the respective tabs, coding for file action can readily be displaced—again without regard to the way that the file is originally oriented.

In this way, when the rotating tab is rotated with its file identification and content display portion, a locking of the rotating tab mechanism occurs.

The flexibility of the tab system here shown can be further understood with respect to FIGS. 1A and 1B. In both of these cases, the tab T displays above the files. By the same rotation illustrated, display could be selectively to the sides of the files. Further, tab T could be oriented to the inside of some of the files to that display of the tab T occurred only on a selective basis.

What is claimed is:

1. In a file folder having:

at least front and rear file sides having first and second adjacent edges for supporting said file during storage and respective third and fourth edges respectively opposite said first and second edges;

hinge means joining said file sides along a said first edge thereof for permitting said file sides to open and close relative to one another for storing file contents between said file sides; and, a tab positioned at an edge of said file selected from said third and fourth edges of said file;

the improvement to said tab comprising:

a tab body having an identification and content display portion, a mounting portion including a defined corner;

pivot means for mounting said mounting portion of said tab body at a corner of one of said file sides between third and fourth edges, said pivot means permitting rotation of said tab with respect to said file side and juxtaposed to said third and fourth edges to enable said content display portion to protrude selectively beyond either edge of said file selected from said third and fourth edge for the display of file identification and content information from either of said third and fourth edges; and, at least one notch acting between said mounting portion of said tab at said defined corner and said file side for enabling said tab to be locked with respect to said at least one of said third and fourth file edge to inhibit rotation of said tab.

2. The file folder of claim 1 and including:

first and second notches acting between said mounting portion of said tab and said file side for enabling said tab to be locked with respect to said each said third and fourth file edge to inhibit rotation of said tab.

3. A file folder comprising:

at least front and rear file sides having first and second adjacent edges for supporting said file during storage and respective third and fourth edges respectively opposite said first and second edges;

hinge means joining said file sides along a said first edge thereof for permitting said file sides to open and close relative to one another for storing file contents between said file sides; and, a tab body having an identification and content display portion and a mounting portion including a defined corner;

pivot means for mounting said mounting portion of said tab body at a corner of one of said file sides between third and fourth edges, said pivot means permitting rotation of said tab with respect to said file side and juxtaposed to said third and fourth edges to enable said content display portion to protrude beyond an edge of said file selected from said third and fourth edges for the display of file identification and content information; and, at least one notch acting between said mounting portion of said tab at said defined corner and said file side for enabling said tab to be locked with respect to said at least one of said third and fourth file edge to inhibit rotation of said tab.

4. The file folder of claim 3 and including:

first and second notches acting between said mounting portion of said tab and said file side for enabling said tab to be locked with respect to said each said third and fourth file edges to inhibit rotation of said tab.

* * * * *